United States Patent [19]

Stanley

[11] Patent Number: 4,662,194

[45] Date of Patent: May 5, 1987

[54] APPARATUS FOR DYEING YARN STRANDS

[75] Inventor: Frankie B. Stanley, Dalton, Ga.

[73] Assignee: J. W. Yarbrough, Chatsworth, Ga.; a part interest

[21] Appl. No.: 781,418

[22] Filed: Sep. 30, 1985

[51] Int. Cl.[4] ..... D06B 1/02; D06B 11/00

[52] U.S. Cl. ..... 68/205 R

[58] Field of Search ..... 68/205 R; 118/DIG. 21, 118/323, 325; 134/122 R

[56] References Cited

U.S. PATENT DOCUMENTS

| | | | |
|---|---|---|---|
| 3,650,281 | 3/1972 | Hurst | 118/323 X |
| 3,688,530 | 9/1972 | Harris et al. | 68/205 R |
| 3,827,262 | 8/1974 | Manuel | 68/205 R X |
| 3,899,903 | 8/1975 | Lapierre | 68/205 R |
| 4,231,239 | 11/1980 | Lazaroff | 68/205 R |
| 4,547,921 | 10/1985 | Otting et al. | 68/205 R X |
| 4,578,965 | 4/1986 | Brossman | 68/205 R |

*Primary Examiner*—Philip R. Coe

*Attorney, Agent, or Firm*—Rodgers & Rodgers

[57] ABSTRACT

A continuously moving substantially horizontal yarn strand is dyed at spaced intervals by means of an oscillatable elongated tube disposed above and generally parallel to the yarn strand and having spaced apertures in its lower portion so that liquid dye supplied into said oscillatable tube is deposited by gravity onto the yarn strand from the apertures in the tube during oscillation of the tube about its horizontal axis.

11 Claims, 4 Drawing Figures

APPARATUS FOR DYEING YARN STRANDS

TECHNICAL FIELD

This invention relates to dyeing of yarn strands which may be either natural or man made and is particularly applicable to dyeing of yarn strands at high speed for use in the manufacture of carpets.

BACKGROUND ART

U.S. Pat. No. 2,234,914 issued Mar. 11, 1941 discloses an apparatus in which a plurality of parallel yarn strands are applied with dye from a conduit which is disposed above and in transverse relation to the yarn strands and from which downwardly extending nozzles depend and through which dye is supplied to the strands of yarn, the transverse conduit and its downwardly depending nozzles being transversely reciprocable relative to the yarn strands.

Since the apparatus of this prior patent is arranged to apply dye at only one point along the length of yarn strands during each transverse movement, it is quite slow in performing a yarn dyeing operation.

U.S. Pat. No. 4,100,724 issued July 18, 1978 discloses apparatus in which a yarn strand is passed under dye injection nozzles and then through a blower nozzle which twists the yarn and disposes of surplus dye liquid.

U.S. Pat. No. 4,361,019 issued Nov. 30, 1982 discloses a yarn dyeing apparatus wherein one or more strands of yarn is passed through a falling stream of liquid dye which is at boiling temperature. The falling stream may be interrupted intermittently or may be traversed to and fro of the yarn so as to dye the yarn intermittently. Provision is made for passing the yarn through a dye vat so as to dye portions of the yarn which were not dyed by the reciprocal applicator.

DISCLOSURE OF THE INVENTION

According to this invention in one form, a method and apparatus are provided for making spaced applications of dye to a continously moving substantially horizontal yarn strand, the apparatus comprising an oscillatable elongated tube disposed above and generally parallel to the yarn strand and in which one or more apertures are formed in the lower portion of the tube so that liquid dye supplied into the tube is applied to the yarn strand in an intermittent fashion due to oscillation of the tube about its horizontal axis during movement of the strand along a straight path.

BEST MODE OF CARRYING OUT THE INVENTION

Figure 1:
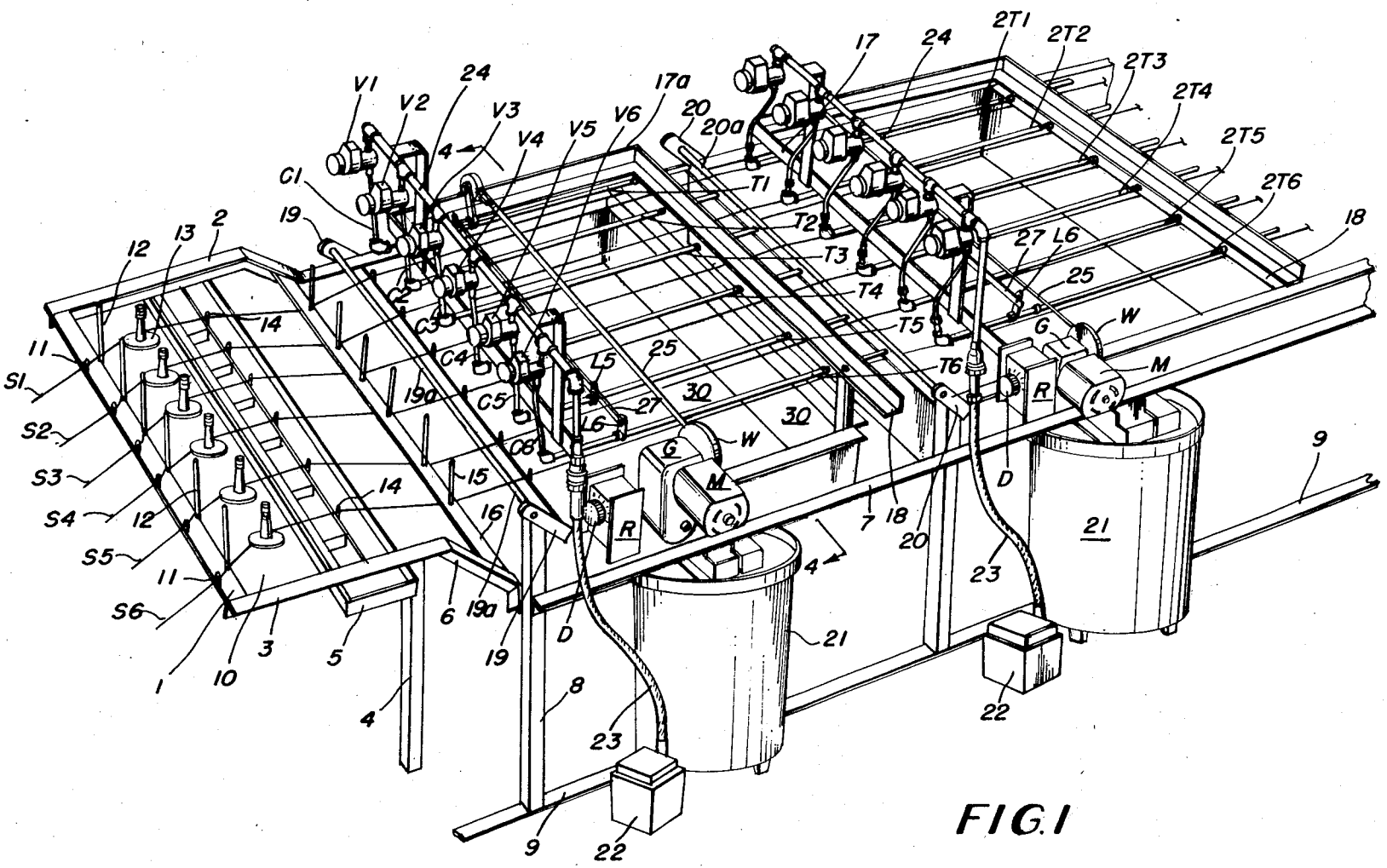
FIG. 1 is an overall perspective view of a yarn dyeing machine formed according to this invention.
Figure 2:
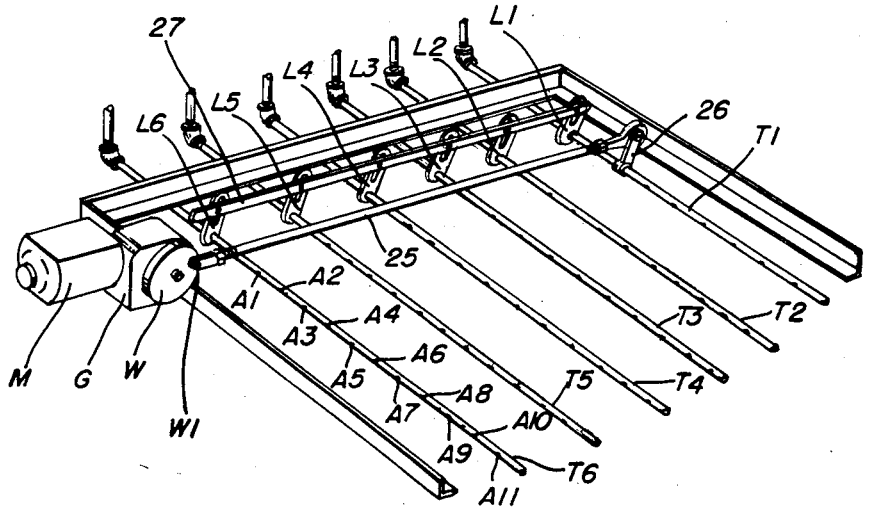
FIG. 2 is a perspective view partially broken away and which shows oscillatable tubes having apertures formed along their lower surfaces together with gang operating linkage means for simultaneously oscillating the tubes.

In FIG. 1 a plurality of strands of yarn designated by the numerals S1–S6 inclusive are shown entering the infeed end of the machine. These strands are supplied from individual cones mounted to the left of the apparatus shown in FIG. 1 and which are not shown in the drawing.

The frame of the machine includes a transverse bar designated by the numeral 1 which is mounted at its ends to longitudinal bars 2 and 3 supported by vertical post 4 and another vertical post on the far side of the machine which is not observable in the drawing. Suspended underneath and secured to the longitudinal bars 2 and 3 is a drop eye bar bracket 5. A strut 6 interconnects longitudinal bar 3 and horizontal main frame bar 7 supported by vertical post 8 mounted on horizontal frame bar 9. Plate 10 is secured to longitudinal bars 2 and 3.

The yarn strands S1–S6 cooperate with the machine elements in identical fashion so that only one strand such as S6 will be described in detail in conjunction with the machine elements. These strands initially enter yarn guides 11 supported by bar 1 and thence alongside vertical guide 12 to tension devices 13 and thence through stop elements 14. In the event of a yarn breakage or entanglement, the associated stop element 14 reacts by moving downwardly to initiate a signal which causes the associated stop devices 15 to clamp the affected strand to the lower one of the closely spaced bars 16 thereby to prevent further withdrawal of the strand from its cone. This signal from stop element 14 also automatically shuts off the flow of liquid dye to the disaffected strand.

In accordance with a principal feature of this invention horizontally disposed oscillatable tubes T1–T6 are journally supported at their ends by transverse support bars 17 and 18 interconnected by bar **17*a* which are supported by elements of the frame. Cross bar 19*a* is supported at its ends by brackets 19 and serves to maintain the fiber strands at proper level on entering the first set of tubes T1–T6. In like fashion cross bar 20*a* over which the strands flow serve to hold the fiber strands at the proper level on entering the second set of tubes 2T1–2T6**.

Liquid dye is supplied from holding tank 21 by means of a conventional pump 22 and a conduit 23 to transverse cross conduit 24. Dye from conduit 24 is supplied downwardly through electrically controlled shut off valves V1–V6 and flexible conduits C1–C6 to the tubes T1–T6 respectively. From FIG. 1 it is apparent that strands S1–S6 are fed below the tubes T1–T6 respectively.

For the purpose of oscillating the tubes T1–T6 about their horizontal axes, an electric motor M is provided and drives a gear box G which in turn rotates a driving wheel W connected at W1 with rod 25 so as to impart oscillatory movement to rod 25 and crank arm 26 to oscillatable tuba T1. This oscillation by virtue of levers L1–L6 and reciprocable link 27 imparts oscillatory motion to all of the tubes T1–T6. The velocity of rotation of motor M and hence the frequency of oscillation of tubes T1–T6 inclusive is controlled by rheostat R having a dial D. Dial D is arranged to cooperate with suitable indicia on the adjacent side of rehostat R so that oscillation frequency may be directly determined by the location of dial D which fact is useful to an operator when a particular dyeing condition is to be repeated.

Valves V1–V6 are electrically controlled shut off valves of conventional construction and simply function to shut off the flow of dye through a particular valve such as V6 at such time as the shut off switch for yarn strand S6 such as 14 operates due to a breakage or entanglement of yarn strand S6.

Figure 3:
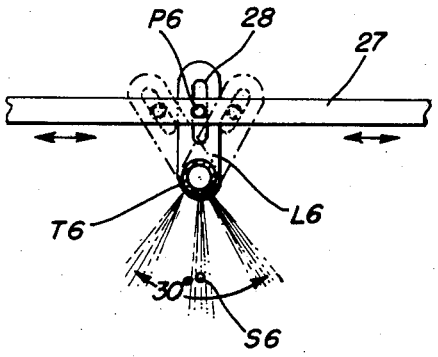
FIG. 3 is a fragmentary cross sectional view of one oscillatable tube which shows the extreme positions into which the tube is oscillated and FIG. 4 is a cross sectional view taken along the line designated 4—4 in FIG. 1 and which shows an open catch basin for receiving the dye discharged from the oscillatable tubes together with a holding tank disposed therebelow and into which the dye flows from the open catch basin for subsequent reuse.

FIG. 3 shows the transverse bar 27 together with the slot such as 28 formed in link such as L6 whereby angular movement of link such as L6 is accommodated by the lost motion connection between the pin such as P6 which rides in the slot 28 formed in link L6. Each oscillatory tube such as L1–L6 includes a plurality of aligned apertures such as A1–AII formed along the lower portion of the tube as shown and identified in connection with a tube such as T6. These apertures may be spaced apart as desired and preferably in the range between one quarter inch and eighteen inches. A desirable spacing of these apertures is two inches. For some applications of the invention one or more of the apertures A1–A11 may be closed by suitable removable closure means such as adhesive tape or other suitable means.

Since each strand such as S1–S6 is located immediately below and in parallel relation to the associated tube such as T1–T6 respectively, the discharge of dye is applied to the associated strand such as S6 intermittently and the maximum angle through which each oscillatable tube oscillates is approximately 30 degrees as is indicated in FIG. 3 although this angle can be of different preferably smaller magnitude if desired. Of course this action of each oscillatable tube makes spaced applications of dye to the associated strand which is moving at a velocity preferably of approximately 600 feet per minute. Of course the velocity of movement of the strands can be changed if need be. Preferably the velocity of strand movement is in a range between one hundred feet per minute to 1500 feet per minute. For special applications of the invention the strand movement may be less than one hundred feet per minute.

An additional element of control is achieved by virtue of the control of the velocity of oscillation of the tubes T1–T6 which is controlled by control means in the form of the rheostat R which is manually controllable by means of the dial D.

Figure 4:
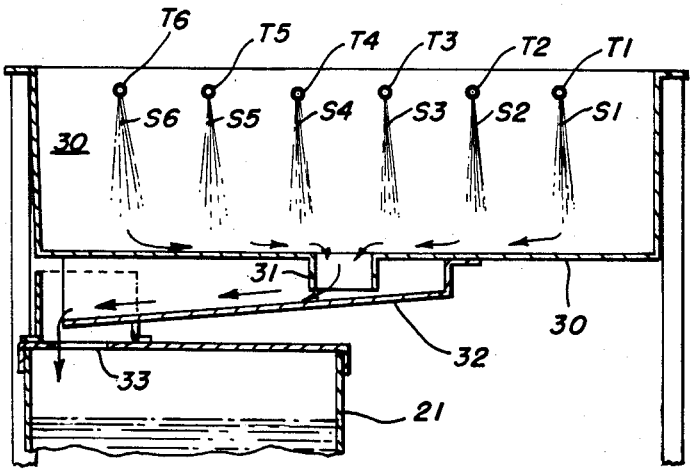

For the purpose of collecting dye which is discharged from the tubes T1–T6 but which is not absorbed by the associated yarn strands, a catch basin 30 is provided. Dye from tank 30 as shown in FIG. 4 flows through outlet 31 into channel 32 and through entry port 33 to holding tank 21 from whence it is supplied by electric pump 22 and conduit 23 to the various oscillatable tubes as already explained. The dye is at room temperature throughout the dyeing operation.

As is apparent from FIG. 1 a second series of oscillatable tubes such as 2T1–2T6 may be provided in accordance with one aspect of this invention. In which case, the strands such as S1–S6 simply continue through the corresponding tubes such as 2T1–2T6 inclusive respectively and a different colored dye may be applied by the second set of tubes to the same strands which have previously been applied with spaced applications of dye by the tubes T1–T6 inclusive. Other portions of the apparatus associated with the second dyeing stage are identical to those described in connection with the first dye stage so that a detailed description of those elements is not deemed necessary.

When the yarn is dyed it is supplied through a drying apparatus from whence it is rewound on cones ready for use in a subsequent process.

INDUSTRIAL APPLICABILITY

A method and apparatus according to this invention may be used with man made or natural fibers and can perform a solid dyeing operation as well as spaced dyeing by appropriate adjustment of the controllable aspects such as the velocity of movement of the yarn strands and the frequency of oscillation of the oscillatory tubes. Since the machine has no moving parts, it is safe and quiet in operation and down time is minimized because in the event of the breakage of one strand, the remaining strands continue through the dyeing operation. Since no cooling time is required the machine operates at very high speed compared to known apparatus and requires a small number of operators since most aspects of normal operation are automatic.

I claim:

1. Apparatus for making spaced applications of dye to a continously moving substantially horizontal straight strand, said apparatus comprising means for imparting continuous movement to said strand, an oscillatable elongated straight tube disposed above and generally parallel to said yarn strand, at least one aperture formed in the lower portion of said tube, means for supplying liquid dye into said tube, and means for oscillating said tube about its horizontal axis so as to deposit dye on said strand at spaced intervals.

2. Apparatus according to claim 1 wherein a plurality of aligned apertures are formed in the lower portion of said tube.

3. Apparatus according to claim 2 wherein said apertures are spaced apart by a distance of approximately two inches.

4. Apparatus according to claim 2 wherein said apertures are spaced apart by a distance within the range between one-quarter inch and eighteen inches.

5. Apparatus according to claim 2 wherein removable closure means is arranged to close preselected ones of said apertures.

6. Apparatus according to claim 1 wherein said yarn strand moves at a velocity in the range of one hundred feet per minute to fifteen hundred feet per minute.

7. Apparatus according to claim 1 wherein the angle through which said tube is oscillated is approximately 30 degrees.

8. Apparatus according to claim 1 wherein control means determines the frequency of oscillation of said tube about its horizontal axis.

9. Apparatus according to claim 1 wherein a plurality of generally parallel moving yarn strands are dyed simultaneously by a plurality of oscillatable apertured tubes disposed respectively above said yarn strands and into which dye is supplied.

10. Apparatus according to claim 9 wherein a reciprocable common operating linkage imparts oscillatory movement to said tubes.

11. Apparatus according to claim 10 wherein the frequency of reciprocation of said common operating linkage is controllable by control means which is manually adjustable.

* * * * *